United States Patent [19]

Gerhard

[11] Patent Number: 4,707,334

[45] Date of Patent: Nov. 17, 1987

[54] ISOLATION METHOD AND APPARATUS FOR STERILIZING CHAMBERS OF FILLING MACHINES

[75] Inventor: Tolasch Gerhard, Wentorf, Fed. Rep. of Germany

[73] Assignee: Kolubus GmbH & Co. KG, Rahden, Fed. Rep. of Germany

[21] Appl. No.: 878,417

[22] Filed: Jun. 25, 1986

[30] Foreign Application Priority Data

Jun. 27, 1985 [DE] Fed. Rep. of Germany ..... 3522996

[51] Int. Cl.[4] ..... A61L 2/00; A23L 3/00; B65B 55/02

[52] U.S. Cl. ..... 422/28; 422/29; 422/31; 422/33; 422/304; 53/425; 53/510; 414/217; 414/221; 426/399; 99/362

[58] Field of Search ..... 422/28, 29, 31, 33, 422/300, 302, 304; 53/425, 510; 414/217, 218, 221; 99/360, 361, 362; 426/399, 400, 401

[56] References Cited

U.S. PATENT DOCUMENTS 3,341,280 9/1967 Eolkin ..... 414/218
3,747,296 7/1973 Zausner ..... 422/304

FOREIGN PATENT DOCUMENTS 2509611 9/1976 Fed. Rep. of Germany .
655851 8/1951 United Kingdom .

*Primary Examiner*—David L. Lacey
*Assistant Examiner*—Floyd E. Bennett
*Attorney, Agent, or Firm*—Chilton, Alix & Van Kirk

[57] ABSTRACT

A chamber, in which an atmosphere comprising a toxic vapor is established, is pneumatically isolated from the ambient environment. The isolation technique permits objects to be sterilized to be conveyed into and removed from the chamber without leakage of vapor from the chamber or of air into the chamber.

17 Claims, 2 Drawing Figures

ISOLATION METHOD AND APPARATUS FOR STERILIZING CHAMBERS OF FILLING MACHINES

BACKGROUND OF THE INVENTION

1. FIELD OF THE INVENTION

This invention relates to a sterilization process and particularly to a method for isolating a chamber in which an antiseptic atmosphere is created from the ambient atmosphere in order to prevent the escape of toxic sterilizing agents from such chamber and to prevent the ingress of microorganisms to such chamber. More specifically, the present invention is directed to apparatus for establishing a barrier about a conveyor which transports articles to be sterilized so that such articles may be conveyed from the ambient atmosphere into a chamber where such articles are subjected to the action of a toxic sterilizing agent, the apparatus also isolating the sterilizing chamber from a filling chamber immediately downstream thereof so that the sterilizing agent does not flow into the filling chamber. Accordingly, the general objects of the present invention are to provide novel and improved methods and apparatus of such character.

2. DESCRIPTION OF THE PRIOR ART

While not limited thereto in its utility, the present invention is particularly well-suited for use in the sterilization of open-topped containers. Such containers are, for example, commonly employed in the packaging and subsequent retail sale of dairy products. The containers in question must be treated, i.e., sterilized, so as to be substantially free of live microorganisms at the time of filling. A particularly efficient means for the sterilization of such containers is the wet aseptic process wherein an agent, for example a peroxide, is employed. Such sterilizing agents are toxic and thus the release thereof to the ambient atmosphere must be prevented.

It is common, in the packaging of products which require a sterilized container, for the sterilized containers to be filled immediately subsequent to the sterilization thereof. Accordingly, it would be desireable to employ a continuous conveyor wherein the containers which are to be sterilized and subsequently filled are transported from the ambient atmosphere through the sterilizing atmosphere and then immediately to a filling station. In view of the toxicity of the sterilizing agent, it is necessary to take steps to prevent the flow of sterilizing agent from the sterilizing chamber to the downstream filling station.

There has been a long-standing desire in the art to improve the efficiency of packaging systems wherein the containers are transported from the ambient atmosphere through a sterilizing chamber and thence to a filling station in substantially continuous fashion. Particularly, improvements have long been needed in the methods and apparatus for preventing escape of the toxic sterilizing agents either to the ambient atmosphere or to the filling station while simultaneously preventing the in-flow of the ambient atmosphere to the sterilizing chamber or to the vicinity of the filling station.

SUMMARY OF THE INVENTION

The present invention constitutes an improvement over the prior art and, in so doing, provides a novel and improved method for pneumatically isolating a chamber wherein an atmosphere of toxic sterilizing agent is maintained, such chamber possessing entry and exit apertures. The present invention also encompasses novel apparatus for preventing the escape of sterilizing agents from a treatment chamber in a reliable and efficient manner while simultaneously preventing the ingress of microorganisms to such chamber, the said novel apparatus being particularly well-suited for use in filling apparatus wherein a conveyor system moves containers to be filled sequentially through the sterilizing atmosphere and to a filling station.

The present invention employs air-lock type devices at the entry and exit apertures of a sterilizing chamber, such air-lock type devices cooperating with a conveyor system for containers to be sterilized, and the containers themselves, to define flow-restricting cross-sections which define distinct pressure zones within the air-locks. Pressure adjustments thus enable the establishment of gas flow patterns which make it impossible for the toxic sterilizing agents or microorganisms to pass in either direction through the air-locks, i.e., the directions of the gas flows which provide the requisite isolation of the sterilizing chamber is accomplished by pressure balancing.

BRIEF DESCRIPTION OF THE DRAWING

The present invention may be better understood, and its numerous objects and advantages will become apparent to those skilled in the art, by reference to the accompanying drawing wherein like reference numerals refer to like elements in the two figures and in which.

DESCRIPTION OF THE ENCLOSED EMBODIMENT

Figure 1:
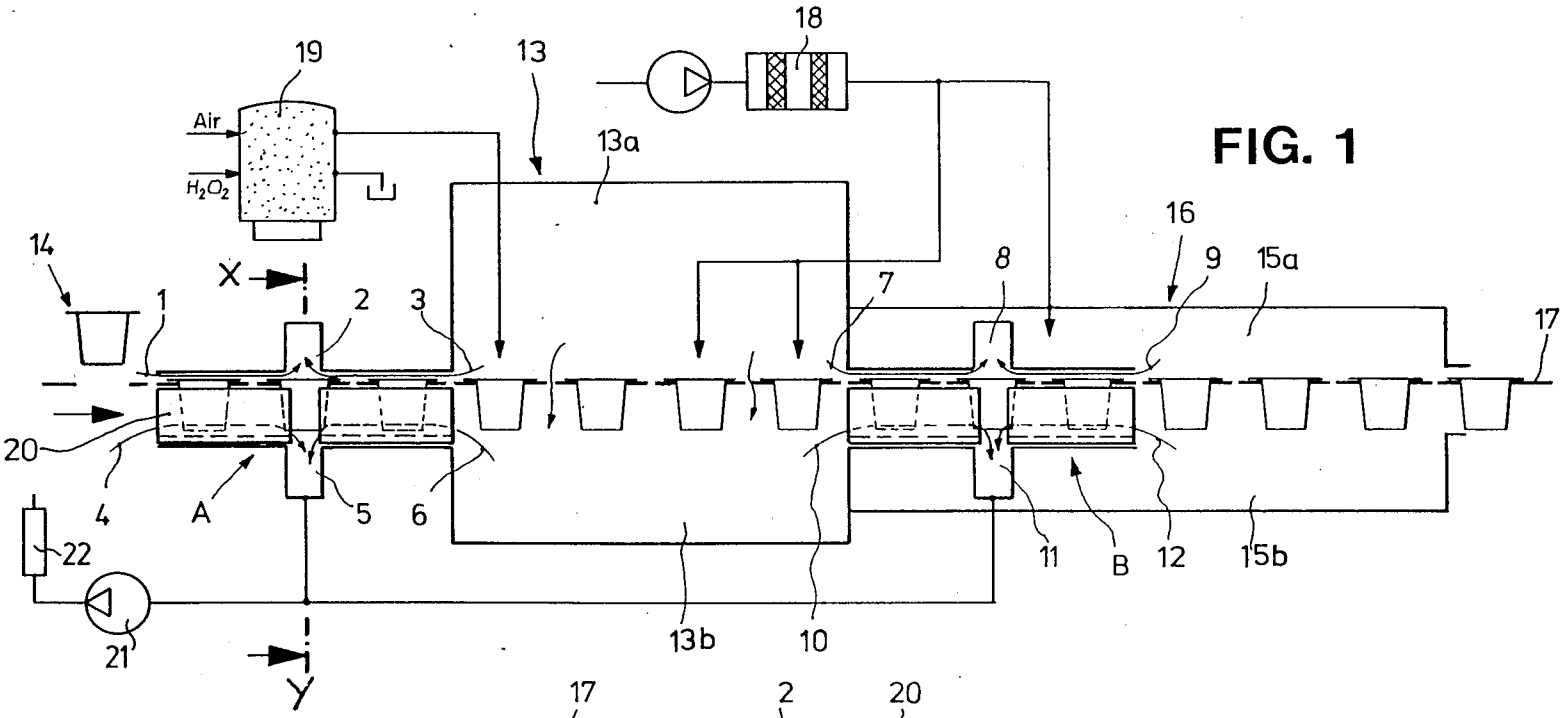
FIG. 1 is a schematic, side-elevation view of a filling machine employing the present invention.

With reference now to the drawing, a sterilizing chamber is indicated generally at 13. Sterilizing chamber 13 forms part of a machine which fills containers with products which are subject to spoilage in the presence of microorganisms. The sterilizing chamber 13 is located downstream of a container feed station, indicated generally at 14. A filling chamber, indicated generally at 16 is located downstream of chamber 13. It will be understood that the filling chamber 16 will include a means for filling sterilized containers with the product being packaged and means for hermetically sealing the filled containers, these means having been omitted from the drawing in the interest of facilitating understanding of the prsent invention.

In accordance with the invention, the sterilizing chamber 13 and the filling chamber 16 are divided into respective upper regions 13*a* and 15*a* and lower regions 13*b* and 15*b* by means of a chain driven conveyor 17. The conveyor has apertures for receiving the containers to be sterilized, the containers being provided with rims by which they are supported from the conveyor in the disclosed embodiment. With the exception of the conveyor entry and exit apertures, and the connection to a source of sterilizing agent, the sterilizing chamber 13 is completely sealed from the ambient atmosphere.

The containers to be sterilized and subsequently filled are transferred to the conveyor 17 at the feed station 14 and immediately enter a pressure air-lock A. The containers pass through the air-lock A into the sterilizing chamber 13. Subsequent to sterilization, the containers leave the chamber 13 via a second pressure air-lock B and, via air-lock B, pass into the filling chamber 16. Sterile air, at a pressure in excess of the ambient atmospheric pressure, is supplied to filling chamber 16 via an air-sterilization filter 18. Because of the construction of the conveyor system, which will be described in greater detail below, the pressure of the sterilized air in the space 13*a* above conveyor 17 will be maintained at a level which is somewhat higher than in the space 13*b* below conveyor 17.

The sterilization of the containers takes place in the chamber 13 utilizing, for example, an $H_2O_2$ solution. The sterilization solution is first atomized, for example by means of an ultrasonic atomizer 19, and the droplets comprising the mist thus produced are electrically charged and subsequently electrostatically deposited on the containers. Thereafter, while still in the sterilizing chamber 13, the containers are dried by, for example, blow-drying with heated air from the sterilized air source which flows through filter 18. For a further discussion of the sterilization process, reference may be had to copending application Ser. No. 721,311 entitled "Process and Apparatus for sterilizing Containers" which is assigned to the assignee of the present invention. The disclosure of application Ser. No. 721,311 is hereby incorporated herein by reference.

After sterilization in chamber 13, the containers are transported into filling chamber 16 via the air-lock B. Although chamber 16 is not completely sealed from the ambient atmosphere, as noted above, an atmosphere of sterile air at a pressure above atmospheric is maintained within chamber 16. Accordingly, the ambent air is blocked from flowing into the chamber 16.

Figure 2:
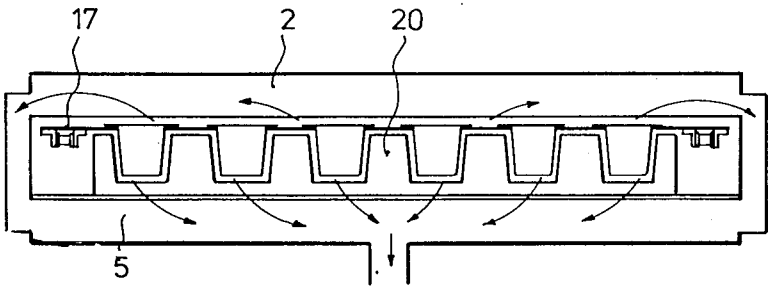
FIG. 2 is a sectional view taken along line X-Y of FIG. 1.

In accordance with the invention, the pressure air-lock A comprises a first suction off-take or chamber 2, with associated flow paths 1 and 3, and a second suction off-take or port 5, with associated flow paths 4 and 6. Analogously, the pressure air-lock B, on the exit side of chamber 13, comprises suction off-takes 8 and 11 with respective flow paths 7, 9 and 10, 12. The conveyor 17 cooperates with the containers to be sterilized such that, as schematically illustrated in FIG. 2, two distinct pressure zones, respectively above and below the conveyor, are delimited by flow-restricting cross-sections. Accordingly, mixing of the suction induced flow at the lower side of the containers with the flow induced at the upper side of the containers within each air-lock is prevented by relative pressure differentials.

In the interest of achieving effective isolation and maintaining constant pressures, the containers and cooperating moving conveyor form one component of the pressure zone delimiting means. The other component of the pressure zone delimiting means, as may be seen from FIG. 2, defined by channels 20 which extend through the air-locks and are shaped to conform to the outline of the containers, The channels 20 extend upstream and downstream of the suction off-takes and thus are interrupted thereby. The lengths of the air-locks are chosen such that, in the direction of container movement, a plurality of rows of containers are continually present within the flow-restricted zones.

The cooperating configuration of the channels, conveyor and containers results, as noted, in the formation of upper and lower restricted gas flow paths. These gas flow paths are each divided into two independent restricted flow-path portions, i.e., the portions upstream and downstream of the suction off-takes, the lowest pressure in the system thus occurring at the junction between the lower flow-path portions. This low pressure will be lower than the ambient atmospheric pressure.

The greater pressure depression, i.e., the lower absolute pressure, prevailing below the conveyor-container combination results in a downwardly directed flow through apertures provided in conveyor 17 both in the sterilizing chamber 13 and in the filling chamber 16. Accordingly, any microorganisms which may be adhering to the exterior of a container are subjected to a downwardly-directed flow of sterilizing agent and subsequently to a similarly directed flow of sterilized air. These downward flows reliably prevent such microorganisms from contact with either the interior of a container or with the product with which the container is being filled.

The pressure air-locks A and B, when designed in accordance with the present invention, prevent direct gas flow into chambers 13 and 16 in the direction of movement of the conveyor. Thus, ambient air following flow-paths 1 and 4 cannot pass the suction off-takes 2 and 5 and enter sterilizing chamber 13 while toxic sterilizing agent following flow-paths 7 and 10 cannot pass suction off-takes 8 and 11 and enter the filling chamber 16. Thus, the ingress of microorganisms is prevented and flow of the $H_2O_2$ fog into the filling zone is likewise prevented. There is no need to hermetically seal the chamber 16 from the ambient atmosphere because, as discussed above, it is subjected to an overpressure of sterile air. This pressurized sterile air follows the flow-paths 9 and 12 in air-lock B and also effectively blocks any ambient air in flow around the conveyor exit aperture from chamber 16. The control of pressure, for example the maintenance of a higher sterile air pressure in the zone 15*a* than in the zone 15*b*, is obtained by selecting appropriate cross-sections for the sterile air supply line and the suction off-takes 8 and 11 as well as by appropriate selection of the pressure of the sterile air and that of the vacuum source 21 attached to the suction port of suction off-take 11. As noted, no airborne impurities can enter either of chambers 13 or 16 since an overpressure, i.e., a pressure above that of the ambient atmosphere, is maintained throughout the entire system.

It is also to be noted that, as illustrated schematically in FIG. 1, the stream of gas drawn off of the suction off-takes 5 and 11 may be stripped of toxic substances by passage through a catalyst as indicated schematically at 22 and then returned to the intake ducts of the system for reuse.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a sterilizing method which includes the establishment of a toxic sterilizing atmoshpere in a first chamber, the first chamber having entrance and exit apertures, the improvement comprising the step of:

creating plural zones of different pressure in series with each of the first chamber entrance and exit apertures, the pressure in said zones being less than either the pressure in the first chamber or the ambient atmospheric pressure, said zones being located exteriorly of the first chamber; and establishing gas flows directed to each of said zones, said directed flows including flows from the first chamber through said apertures to each of said zones and flows directed oppositely with respect to said flows from the first chamber, said oppositely directed flows preventing escape of toxic material from the first chamber to the ambient atmospheres upstream of the chamber entrance aperture and downstream of the chamber exit aperture, said flows from the first chamber preventing ingress of gas comprising said oppositely directed flows to the chamber.

2. The method of claim 1 wherein the step of creating plural zones of different pressure comprises:

partitioning of an air-lock so as to define flow-restricting cross-sections therein; and establishing a connection between one of the flow-restricting cross-sections of the partitioned air-lock and a low pressure source.

3. The method of claim 2 wherein the first chamber exit aperture is connected by said first chamber exit aperture air-lock to a second chamber via an entrance aperture in the second chamber, the second chamber also having an exit aperture, and wherein said method further comprises the steps of:

delivering sterile gas to the second chamber at a pressure above the ambient atmospheric pressure, the sterile gas flowing from the second chamber through the exit aperture thereof to prevent inflow of air from the ambient atmosphere, the sterile gas from the second chamber also forming a pair of said oppositely directed flows.

4. The method of claim 3 wherein the first chamber is employed in the sterilization of containers delivered thereto via the first chamber entrance aperture and the second chamber is employed for the filling of the sterilized containers which are delivered thereto via the first chamber exit aperture and the second chamber entrance aperture, said method additionally including the step of:

moving containers to be sterilized serially through the first and second chambers while maintaining said zones of different pressure.

5. The method of claim 4 wherein the containers to be sterilized have a depth measured between upper and lower sides thereof and wherein the created zones of different pressure are above and below the upper sides of the containers and wherein the pressures in the said zones above the container upper sides are maintained at a higher level than the pressures in the zones below the container upper sides.

6. The method of claim 5 further comprising the step of:

promoting a flow over the exterior surface of the containers from the container upper sides to below the containers while the containers are in the first chamber.

7. Treatment apparatus comprising:

treatment vessel means for establishing a treating atmosphere, said vessel means having entrance and exit apertures for articles to be treated;

first air-lock means, said first air-lock means being connected in series with said vessel means entrance aperture and including:

means defining a first multi-zone chamber, the zones of said first multi-zone chamber being in fluid communication;

means coupling a first zone of said first multi-zone chamber to a source of low pressure whereby pressures less than that within said vessel means will be produced in said first multi-zone chamber, a pressure differential being established between said zones;

first means defining restricted flow-paths between the interior of said vessel means and said zones of said first multi-zone chamber; and second means defining restricted flow-paths between the ambient atmosphere and said zones of said first multi-zone chamber, the flow-paths established by said first and second restricted flow-path defining means being oppositely directed and generally coplanar; and second air-lock means, said second air-lock means being connected in series with said vessel means exit aperture and including:

means defining a second multi-zone chamber, the zones of said second multi-zone chamber being in fluid communication;

means coupling a first zone of said second multi-zone chamber to a source of low pressure whereby a pressure less than that within said vessel means will be produced in said second multi-zone chamber, a pressure differential being established between said zones;

means defining a pair of restricted-flow paths between the interior of said vessel means and said second multi-zone chamber; and second means defining a pair of restricted flow-paths between the ambient atmosphere and said zones of said second multi-zone chamber, the flow paths established by said first and second flow-path defining means being oppositely directed and generally coplanar.

8. The apparatus of claim 7 wherein said treatment apparatus is employed for the sterilization of containers and an atmosphere comprising a toxic substance is established within said vessel means and wherein said apparatus further comprises:

conveyor means, said conveyor means extending through said first and second air-lock means and said vessel means, said conveyor means including: an apertured band, containers to be sterilized being received in the apertures of said band.

9. The apparatus of claim 8 wherein said band and containers carried thereby divide said first and second multi-zone chamber defining means into an upper zone above said band and a lower zone below said band, the lower of each of said zones being coupled to a source of low pressure whereby a pressure differential will be established in said multi-zone chambers between said upper and lower zones, the pressure above said band in said upper zones being greater than the pressure below said band in said lower zones.

10. The apparatus of claim 9 wherein first and second flow-path defining means each include:

means defining channels which are complementary in shape to the containers to be sterilized, said channel defining means cooperating with said band and the containers to define first restricted flow-paths below said band; and a member which cooperates with said band to establish a second restricted flow-path above said band.

11. The apparatus of claim 10 further comprising:

means for reclaiming for reuse at least a first constituent of the gaseous material withdrawn from said first and second multi-zone chamber defining means as a result of the coupling thereof to a low-pressure source.

12. Apparatus for use in the sterilizing and subsequent filling of containers comprising:

sterilizing means, said sterilizing means including a vessel in which an atmosphere comprising a toxic sterilizing substance is created, said vessel having entrance and exit apertures;

filling means, said filling means comprising a vessel having entrance and exit apertures, a pressurized atmosphere of sterile gas being maintained in said filling means vessel;

means connecting said sterilizing means vessel exit aperture in series with said filling means vessel entrance aperture, said connecting means comprising first air-lock means, said first air-lock means including:

means defining a first multi-zone off-take chamber, a restricted flow-path extending between said zones of said first multi-zone chamber;

means for coupling one zone of said first multi-zone off-take chamber to a source of low pressure whereby pressures less than that within the filling means and sterilizing means vessels will be produced in said zones defined by said first multi-zone off-take chamber;

first means defining restricted flow-paths between the interior of said sterilizing means vessel and each of said zones defined by said first multi-zone off-take chamber; and second means defining restricted flow-paths between said filling means vessel and each of said zones defined by said first multi-zone off-take chamber, the flow-paths established by said first and second flow-path establishing means being oppositely directed and generally coplanar; and means for coupling said sterilizing means vessel entrance aperture to the ambient atmosphere, said coupling means comprising second air-lock means, said second air-lock means including:

means defining a second multi-zone off-take chamber, a restricted flow-path extending between said zones defined by said first chamber;

means for coupling a first zone of said second multi-zone off-take chamber to a source of low pressure whereby pressures less than the ambient atmospheric pressure and the pressure within said sterilizing means vessel will be produced in said zones defined by said second multi-off-take chamber;

third means defining restricted flow-paths between the interior of said sterilizing means vessel and each of said zones defined by said second multi-zone off-take chamber; and fourth means defining restricted flow-paths between the ambient atmosphere and each of said zones defined by said second multi-zone off-take chamber, the flow-paths established by said third and fourth flow-path defining means being oppositely directed and generally coplanar.

13. The apparatus of claim 12 wherein a band and containers carried thereby divide said first and second multi-zone off-take chambers into an upper zone above said band and a lower zone below said band, a low-pressure source being coupled to said lower zone whereby a pressure differential will be established in said multi-zone chambers between said zones, the pressures above said band being greater than the pressures below said band.

14. The apparatus of claim 12 wherein said apparatus is employed for the sterilization of containers and wherein said apparatus further comprises:

conveyor means, said conveyor means extending through said first and second multi-zone off-take chambers and the sterilizing means and filling means vessels, said conveyor means including:

an apertured band, containers to be sterilized being received in the apertures of said band.

15. The apparatus of claim 14 wherein said band and the containers carried thereby divide said first and second multi-zone off-take chambers into an upper zone above said band and a lower zone below said band, a low-pressure source being coupled to said lower zone whereby a pressure differential will be established in said multi-zone chambers between said zones, the pressures above said band being greater than the pressures below said band.

16. The apparatus of claim 14 wherein said means defining restricted flow-paths each include:

means defining channels which are complementary in shape to containers to be sterilized, said channel-defining means cooperating with said band and containers to be sterilized to define a first restricted flow-path below said band; and a member which cooperates with said band to establish a second restricted flow-path above said band.

17. The apparatus of claim 16 further comprising:

means for reclaiming for reuse at least a first constituent of a gaseous material withdrawn from said first and second multi-zone off-take chambers as a result of the coupling thereof to a low pressure source.

* * * * *